US007740090B2

(12) United States Patent
Shen et al.

(10) Patent No.: US 7,740,090 B2
(45) Date of Patent: Jun. 22, 2010

(54) STRESS RELIEF FEATURE ON PDC CUTTER

(75) Inventors: Yuelin Shen, Houston, TX (US); John Youhe Zhang, Tomball, TX (US)

(73) Assignee: Smith International, Inc., Houston, TX (US)

( * ) Notice: Subject to any disclaimer, the term of this patent is extended or adjusted under 35 U.S.C. 154(b) by 76 days.

(21) Appl. No.: 11/372,614

(22) Filed: Mar. 10, 2006

(65) Prior Publication Data

US 2006/0219439 A1 Oct. 5, 2006

Related U.S. Application Data

(60) Provisional application No. 60/667,978, filed on Apr. 4, 2005.

(51) Int. Cl.
*E21B 10/573* (2006.01)

(52) U.S. Cl. ..... 175/428; 175/426

(58) Field of Classification Search ..... 175/426, 175/428, 430, 374
See application file for complete search history.

(56) References Cited

U.S. PATENT DOCUMENTS

| | | | | |
|---|---|---|---|---|
| 3,745,623 | A | 7/1973 | Wentorf et al. | |
| 3,858,671 | A * | 1/1975 | Kita et al. | 175/426 |
| 4,104,344 | A | 8/1978 | Pope et al. | |
| 4,288,248 | A | 9/1981 | Bovenkerk et al. | |
| 4,804,049 | A | 2/1989 | Barr | |
| 4,993,505 | A | 2/1991 | Packer et al. | |
| 5,316,095 | A | 5/1994 | Tibbitts | |
| 5,332,051 | A | 7/1994 | Knowlton | |
| 5,341,890 | A * | 8/1994 | Cawthorne et al. | 175/374 |
| 5,655,612 | A * | 8/1997 | Grimes et al. | 175/401 |
| 5,662,183 | A | 9/1997 | Fang | |
| 5,706,906 | A | 1/1998 | Jurewicz et al. | |
| 5,947,216 | A | 9/1999 | Truax | |
| 6,003,623 | A | 12/1999 | Miess | |
| 6,145,607 | A | 11/2000 | Griffin et al. | |
| 6,408,959 | B2 | 6/2002 | Bertagnolli et al. | |
| 6,488,106 | B1 | 12/2002 | Dourfaye | |
| 6,527,069 | B1 | 3/2003 | Meiners et al. | |
| 6,550,556 | B2 | 4/2003 | Middlemiss et al. | |
| 6,604,588 | B2 * | 8/2003 | Eyre et al. | 175/374 |
| 6,823,952 | B1 | 11/2004 | Mensa-Wilmot et al. | |
| 6,904,984 | B1 * | 6/2005 | Estes et al. | 175/430 |

(Continued)

FOREIGN PATENT DOCUMENTS

| | | |
|---|---|---|
| BE | 1012119 | 5/2000 |

(Continued)

OTHER PUBLICATIONS

Combined Search and Examination Report dated Jul. 31, 2006 for corresponding European Application No. GB0606575.9 (6 pages).

(Continued)

*Primary Examiner*—Daniel P Stephenson

(57) ABSTRACT

A cutter having a base portion, an ultrahard layer disposed on the base portion, and at least one relief groove formed on an outer surface of the cutter. The at least one relief groove is configured to form a relief gap between the ultrahard layer and an inside surface of a cutter pocket.

10 Claims, 5 Drawing Sheets

U.S. PATENT DOCUMENTS

| | | | | |
|---|---|---|---|---|
| 7,086,489 | B2 * | 8/2006 | McDonough | 175/430 |
| 2003/0235691 | A1 | 12/2003 | Griffin et al. | |

FOREIGN PATENT DOCUMENTS

| | | |
|---|---|---|
| CA | 2538807 | 9/2006 |
| CA | 2541267 | 12/2008 |
| EP | 1201873 | 5/2002 |
| GB | 2314360 | 12/1997 |
| GB | 2361936 | 11/2001 |
| GB | 2424013 | 6/2007 |
| GB | 2424910 | 1/2008 |

OTHER PUBLICATIONS

CA Examination Report for CA App. No. 2,538,807 dated Jul. 20, 2009.

Final Office Action dated Oct. 29, 2009 for related U.S. Appl. No. 11/365,298, filed Mar. 1, 2006.

Examiner's report dated Sep. 4, 2007 for related Canadian Application No. 2,538,807, filed Mar. 8, 2006.

Combined Search and Examination Report issued in related GB Application No. 0604699.9 dated Jul. 7, 2006.

Non-Final Office Action dated Feb. 14, 2008 for related U.S. Appl. No. 11/365,298 filed Mar. 1, 2006.

Response filed May 14, 2008 to Non-Final Office Action dated Feb. 14, 2008 for related U.S. Appl. No. 11/365,298 filed Mar. 1, 2006.

Final Office Action dated Sep. 4, 2008 for related application U.S. Appl. No. 11/365,298 filed Mar. 1, 2006.

Response filed Nov. 3, 2008 to Final Office Action dated Sep. 4, 2008 for related U.S. Appl. No. 11/365,298 filed Mar. 1, 2006.

Non-Final Office Action dated Mar. 19, 2009 for related U.S. Appl. No. 11/365,298 filed Mar. 1, 2006.

Response filed Jul. 20, 2009 to Non-Final Office Action dated Mar. 19, 2009 for related U.S. Appl. No. 11/365,298 filed Mar. 1, 2006.

Response filed Dec 29, 2009 to Final Office Action dated Oct. 29, 2009 for related U.S. Appl. No. 11/365,298, filed Mar. 1, 2006.

Response filed Mar 4, 2008 to Examiner's report dated Sep. 4, 2007 for related Canadian Application No. 2,538,807, filed Mar. 8, 2006.

Examiner's report dated Oct. 2, 2008 for related Canadian Application No. 2,538,807, filed Mar. 8, 2006.

Response filed Mar 18, 2009 to Examiner's report dated Oct. 2, 2008 for related Canadian Application No. 2,538,807, filed Mar. 8, 2006.

Response filed Jan. 12, 2010 to Examiner's report dated Jul. 20, 2009 for for related Canadian Application No. 2,538,807, filed Mar. 8, 2006.

Response filed Sep 26, 2006 to Combined Search and Examination Report issued in related GB Application No. 0604699.9 dated Jul. 7, 2006.

CA Exam Report dated Jul. 24, 2007 for related CA application No. 2,541,267.

Response filed Jan. 18, 2008 to CA Exam Report dated Jul. 24, 2007 for related CA application No. 2,541,267.

GB Exam Report dated Jul. 31, 2006 for related GB application No. 0606575.9.

Response file Mar. 23, 2007 to GB Exam Report dated Jul. 31, 2006 for related GB application No. 0606575.9.

Non-Final Office Action dated Mar. 17, 2010 for related application No. 11/365,298 filed Mar. 1, 2006.

* cited by examiner

STRESS RELIEF FEATURE ON PDC CUTTER

CROSS-REFERENCE TO RELATED APPLICATIONS

This application claims benefit under 35 U.S.C. § 119 to U.S. Provisional Application Ser. No. 60/667,978, filed on Apr. 4, 2005. This provisional application is hereby incorporated by reference in its entirety.

BACKGROUND OF INVENTION

1. Field of the Invention

The invention relates generally to the field of fixed cutter bits used to drill wellbores through earth formations.

2. Background Art

Rotary drill bits with no moving elements on them are typically referred to as "drag" bits. Drag bits are often used to drill a variety of rock formations. Drag bits include those having cutters (sometimes referred to as cutter elements, cutting elements or inserts) attached to the bit body. For example, the cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1. The drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultra hard cutter is to be used, the bit body 12 may be made from powdered tungsten carbide (WC) infiltrated with a binder alloy within a suitable mold form. In one manufacturing process the crown 26 includes a plurality of holes or pockets 34 that are sized and shaped to receive a corresponding plurality of cutters 18.

The combined plurality of surfaces 20 of the cutters 18 effectively forms the cutting face of the drill bit 10. Once the crown 26 is formed, the cutters 18 are positioned in the pockets 34 and affixed by any suitable method, such as brazing, adhesive, mechanical means such as interference fit, or the like. The design depicted provides the pockets 34 inclined with respect to the surface of the crown 26. The pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultra hard surface is affixed to a substrate at an angle on a cutter body or a stud so that a desired rake angle is achieved at the working surface.

A typical cutter 18 is shown in FIG. 2. The typical cutter 18 has a cylindrical cemented carbide substrate body 38 having an end face or upper surface 54 referred to herein as the "interface surface" 54. An ultrahard material layer (cutting layer) 44, such as polycrystalline diamond or polycrystalline cubic boron nitride layer, forms the working surface 20 and the cutting edge 22. A bottom surface 52 of the ultrahard material layer 44 is bonded on to the upper surface 54 of the substrate 38. The bottom surface 52 and the upper surface 54 are herein collectively referred to as the interface 46. The top exposed surface or working surface 20 of the cutting layer 44 is opposite the bottom surface 52. The cutting layer 44 typically has a flat or planar working surface 20, but may also have a curved exposed surface, that meets the side surface 21 at a cutting edge 22.

Cutters may be made, for example, according to the teachings of U.S. Pat. No. 3,745,623, whereby a relatively small volume of ultra hard particles such as diamond or cubic boron nitride is sintered as a thin layer onto a cemented tungsten carbide substrate. Flat top surface cutters as shown in FIG. 2 are generally the most common and convenient to manufacture with an ultra hard layer according to known techniques. It has been found that cutter chipping, spalling and delamination are common failure modes for ultra hard flat top surface cutters.

Generally speaking, the process for making a cutter 18 employs a body of tungsten carbide as the substrate 38. The carbide body is placed adjacent to a layer of ultra hard material particles such as diamond or cubic boron nitride particles and the combination is subjected to high temperature at a pressure where the ultra hard material particles are thermodynamically stable. This results in recrystallization and formation of a polycrystalline ultra hard material layer, such as a polycrystalline diamond or polycrystalline cubic boron nitride layer, directly onto the upper surface 54 of the cemented tungsten carbide substrate 38.

It has been found by applicants that many cutters develop cracking, spalling, chipping and partial fracturing of the ultra hard material cutting layer at a region of cutting layer subjected to the highest loading during drilling. This region is referred to herein as the "critical region" 56. The critical region 56 encompasses the portion of the ultrahard material layer 44 that makes contact with the earth formations during drilling. The critical region 56 is subjected to high magnitude stresses from dynamic normal loading, and shear loadings imposed on the ultrahard material layer 44 during drilling. Because the cutters are typically inserted into a drag bit at a rake angle, the critical region includes a portion of the ultrahard material layer near and including a portion of the layer's circumferential edge 22 that makes contact with the earth formations during drilling.

The high magnitude stresses at the critical region 56 alone or in combination with other factors, such as residual thermal stresses, can result in the initiation and growth of cracks 58 across the ultra hard layer 44 of the cutter 18. Cracks of sufficient length may cause the separation of a sufficiently large piece of ultra hard material, rendering the cutter 18 ineffective or resulting in the failure of the cutter 18. When this happens, drilling operations may have to be ceased to allow for recovery of the drag bit and replacement of the ineffective or failed cutter. The high stresses, particularly shear stresses, can also result in delamination of the ultra hard layer 44 at the interface 46.

One type of ultra hard working surface 20 for fixed cutter drill bits is formed as described above with polycrystalline diamond on the substrate of tungsten carbide, typically known as a polycrystalline diamond compact (PDC), PDC cutters, PDC cutting elements, or PDC inserts. Drill bits made using such PDC cutters 18 are known generally as PDC bits. While the cutter or cutter insert 18 is typically formed using a cylindrical tungsten carbide "blank" or substrate 38 which is sufficiently long to act as a mounting stud 40, the substrate 38 may also be an intermediate layer bonded at another interface to another metallic mounting stud 40.

The ultra hard working surface 20 is formed of the polycrystalline diamond material, in the form of a cutting layer 44 (sometimes referred to as a "table") bonded to the substrate 38 at an interface 46. The top of the ultra hard layer 44 provides a working surface 20 and the bottom of the ultra hard layer cutting layer 44 is affixed to the tungsten carbide substrate 38 at the interface 46. The substrate 38 or stud 40 is brazed or otherwise bonded in a selected position on the crown of the drill bit body 12 (FIG. 1). As discussed above with reference to FIG. 1, the PDC cutters 18 are typically held and brazed into pockets 34 formed in the drill bit body at predetermined positions for the purpose of receiving the cutters 18 and presenting them to the geological formation at a rake angle.

FIG. 3 shows a prior art PDC cutter held at an angle in a drill bit 10 for cutting into a formation 45. The cutter 18 includes a diamond material table 44 affixed to a tungsten carbide substrate 38 that is bonded into the pocket 34 formed in a drill bit blade 14. The drill bit 10 (see FIG. 1) will be rotated for cutting the inside surface of a cylindrical well bore. Generally speaking, the back rake angle "A" is used to describe the working angle of the working surface 20, and it also corresponds generally to the magnitude of the attack angle "B" made between the working surface 20 and an imaginary tangent line at the point of contact with the well bore. It will be understood that the "point" of contact is actually an edge or region of contact that corresponds to critical region 56 (see FIG. 2) of maximum stress on the cutter 18. Typically, the geometry of the cutter 18 relative to the well bore is described in terms of the back rake angle "A."

In order for the body of a drill bit to be resistant to wear, hard and wear-resistant materials such as tungsten carbide are typically used to form the drill bit body for holding the PDC cutters. Such a drill bit body is very hard and difficult to machine. Therefore, the selected positions at which the PDC cutters 18 are to be affixed to the bit body 12 are typically formed during the bit body molding process to closely approximate the desired final shape. A common practice in molding the drill bit body is to include in the mold, at each of the to-be-formed PDC cutter mounting positions, a shaping element called a "displacement."

A displacement is generally a small cylinder, made from graphite or other heat resistant materials, which is affixed to the inside of the mold at each of the places where a PDC cutter is to be located on the finished drill bit. The displacement forms the shape of the cutter mounting positions during the bit body molding process. See, for example, U.S. Pat. No. 5,662,183 issued to Fang for a description of the infiltration molding process using displacements.

In addition to bit bodies being formed by infiltrating powered tungsten carbide with, a binder alloy in a suitable mold, a bit body can also be made from steel or other alloys which can be machined or otherwise cut and finished formed using conventional machining and/or grinding equipment. For example, a bit body "blank" may be rough formed, such as by casting or forging, and is finished machined to include at least one blade having mounting pads for cutting elements. The mounting pads may be formed by grinding or machining to include a relief groove.

PDC bits known in the art have been subject to fracture failure of the diamond table, and/or separation of the diamond table from the substrate during drilling operations. One reason for such failures is compressive contact between the exterior of the diamond table and the proximate surface of the bit body under drilling loading conditions. One solution to this problem known in the art is to mount the cutting elements so that substantially all of the thickness of the diamond table is projected outward past the surface of the bit body. While this solution does reduce the incidence of diamond table failure, having the diamond tables extend outwardly past the bit body can cause erratic or turbulent flow of drilling fluid past the cutting elements on the bit. This turbulent flow has been known to cause the cutter mounting to erode, and to cause the bonding between the cutters and the bit body to fail, among other deficiencies in this type of PDC bit configuration.

Other PDC bits known in the art have reduced the turbulent flow caused by the outwardly projected diamond table by including a relief groove formed in the cutter pocket of the bit body. The relief groove reduces the amount of compressive contact between the exterior of the diamond table and the proximate surface of the bit body under drilling loading conditions, thereby reducing the risk of fracture failure of the diamond table, and/or separation of the diamond table from the substrate during drilling operations. Additionally, the PDC cutter may be mounted so that it is substantially flush with the outer surface of the mounting position of the bit body, thereby reducing the amount of turbulent flow created by and outwardly projected diamond table. Thus, relief grooves often reduce diamond table failure, while retaining the benefits of flush mounting of the cutters on the bit body. However, the geometry and dimensions of a cutter pocket with a relief groove are often difficult to control. Additionally, cleaning a pocket with a relief groove requires more work and time.

Displacements are known in the art for forming relief grooves in the cutter pocket of a matrix bit body. U.S. Pat. No. 6,823,952 issued to Mensa-Wilmot, et al. discloses such a conventional displacement configured to form a relief groove in the cutter pocket on the PDC matrix bit body. This patent is incorporated by reference in its entirety. A conventional displacement 102 is shown in FIG. 4. The displacement 102 is a substantially cylindrical body having a selected length indicated by L, a diameter indicated by D and on one end, and a projection 104 having a selected width W. The length L and the diameter D are selected to provide a mounting pad (106 in FIG. 5) on the finished bit body having dimensions suitable to mount a selected cutting element. Typically, the cutting element affixed to the mounting pad (106 in FIG. 5) will be a polycrystalline diamond compact insert. The projection 104 has a substantially cylindrical shape and extends laterally past the exterior surface 102A of the main body of the displacement 102 by about 0.025 inches (0.63 mm). The displacement is affixed to the mold so that the mounting pad is formed to have a recess or relief groove positioned under a diamond table forming part of the cutting element affixed to the mounting pad.

FIG. 5 shows a blade portion of a bit body formed using a displacement, such as shown in FIG. 4. A blade 110 includes thereon a mounting pad 106, having the shape of a displacement. The radius of the mounting pad 106 is determined by the diameter of the displacement. Typically, this radius is selected to match the radius of the cutting element mounted thereon. A relief groove 108 is formed in the mounting pad 106 by having placed the displacement in the mold so that the projection was positioned outward and downward with respect to the blade 110. Shown mounted in the moutning pad 106 is a cutting element 112 consisting of a diamond table 114 affixed to a substrate 116. Typically, the substrate 116 is formed from tungsten carbide or similar hard material. The diamond table 114 can be formed in any manner known in the art for making diamond cutting surfaces for fixed cutter drill bits. The cutting element is typically bonded to the blade 110 by brazing the substrate 116 to the blade 110.

The diamond table 114 extends longitudinally past the surface of the blade 110 by an amount shown at E. The diamond table 114 has a thickness Z which is selected based on the diameter of the cutting element and the expected use of the particular drill bit, among other factors. Diamond table breakage may be reduced efficiently when the depth X of the relief groove 108 is selected so that the relief groove 108 extends back from the surface of the blade 110 at least about 40 percent of that portion (Z-E) of the thickness Z of the diamond table which does not extend past the edge of the blade 110.

While conventional PDC bit bodies have been designed to reduce diamond table failure, the accuracy of designing the cutter pocket has become more difficult, as has cleaning and preparing the pocket.

What is still needed, therefore, is a structure for a PDC bit body which reduces diamond table failure and increases accuracy of designing the cutter pocket.

SUMMARY OF INVENTION

In one aspect, the invention provides an improved cutter. In one aspect, the cutter comprises a base portion, an ultrahard layer disposed on the base portion, and at least one relief groove formed on an outer surface of the cutter. The at least one relief groove is configured to form a relief gap between at least a portion of the ultrahard layer and an inside surface of a cutter pocket.

In another aspect, the invention provides a drill bit comprising a bit body, having at least one cutter pocket, and at least one cutter disposed in the at least one cutter pocket. The at least one cutter comprises a base portion, an ultrahard layer disposed on the base portion, and at least one groove formed on an outer surface of the cutter. The at least one relief groove is configure to form a relief gap between at least a portion of the ultrahard layer and an inside surface of the at least one cutter pocket.

In another aspect, the invention provides a method of drilling comprising contacting a formation with a drill bit, wherein the drill bit comprises a bit body having at least one cutter pocket, and at least one cutter disposed in the at least one cutter pocket. The at least one cutter comprises a base portion, an ultrahard layer disposed on the base portion, and at least one relief groove formed on an out surface of the cutter. The at least one relief groove is configure to form a relief gap between at least a portion of the ultrahard layer and an inside surface of the at least one cutter pocket.

Other aspects and advantages of the invention will be apparent from the following description and the appended claims.

DETAILED DESCRIPTION

Figure 1:
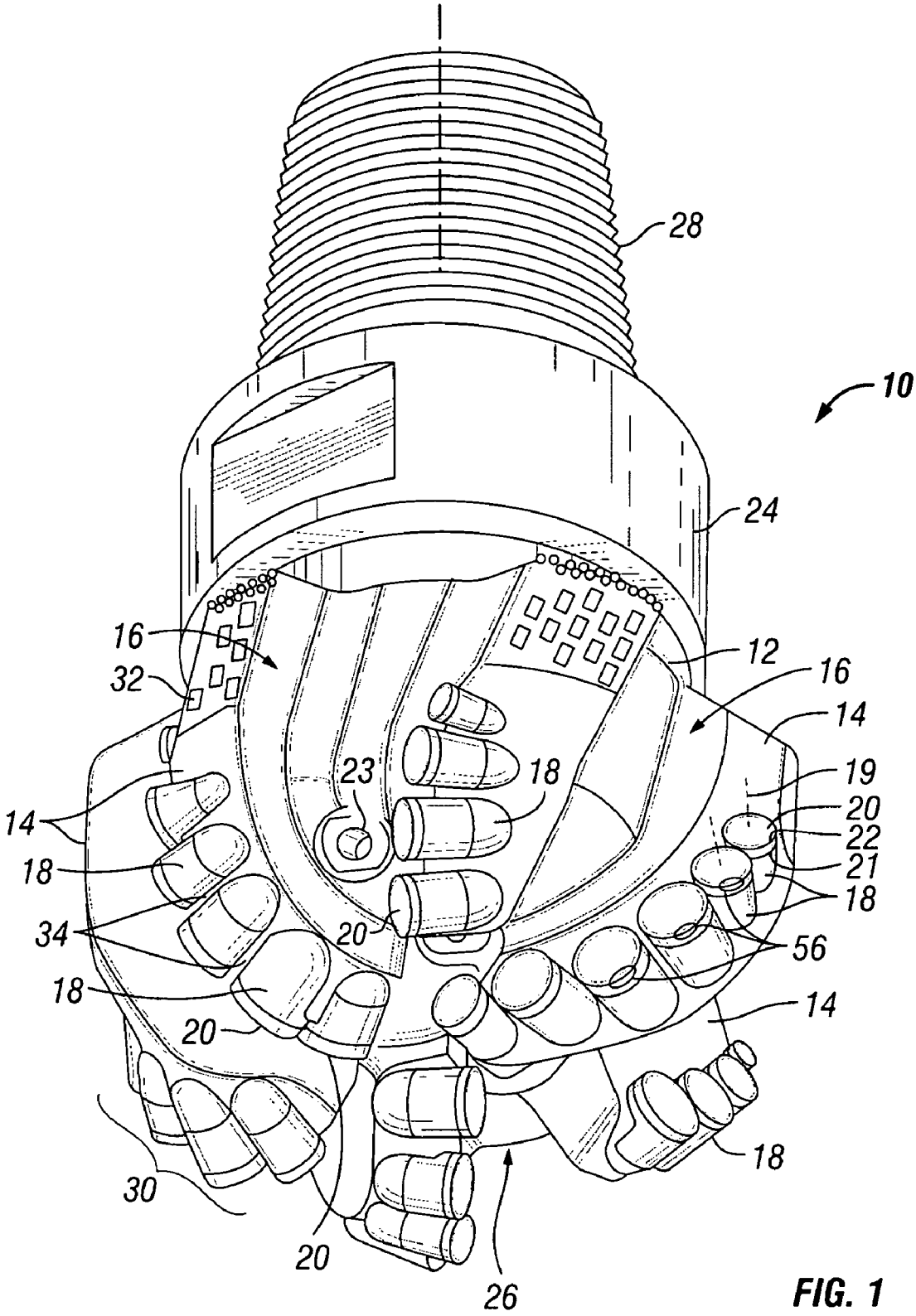
FIG. 1 (Prior Art)
FIG. 1 is a perspective view of a prior art fixed cutter drill bit sometimes referred to as a "drag bit"
Figure 2:
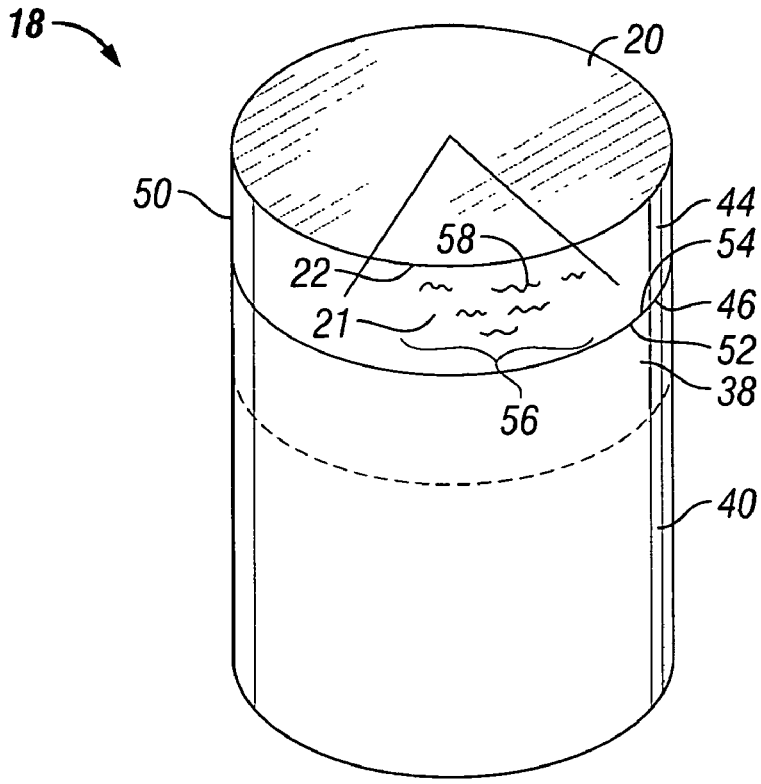
FIG. 2 (Prior Art)
FIG. 2 is a perspective view of a prior art cutter or cutter insert with an ultra hard layer bonded to a substrate or stud.
Figure 3:
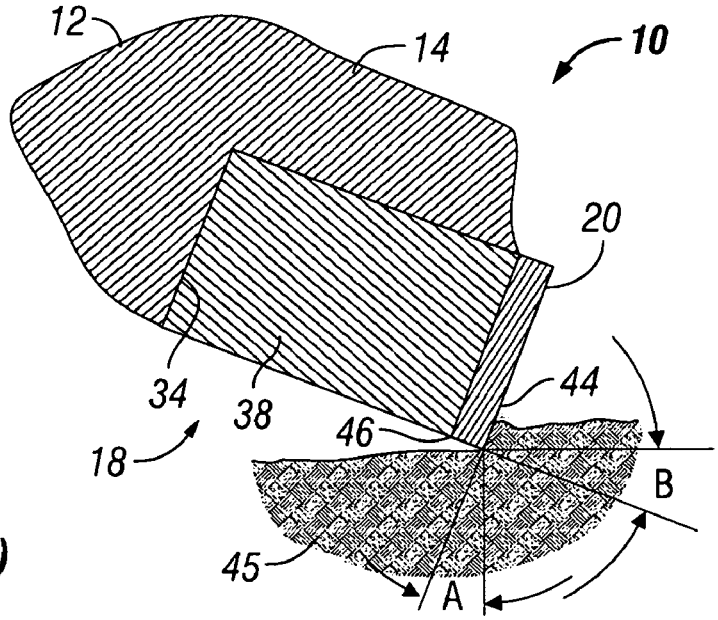
FIG. 3 (Prior Art)
FIG. 3 is a partial section view of a prior art flat top cutter held in a blade of a drill bit engaged with a geological formation (shown in partial section) in a cutting operation.
Figure 4:
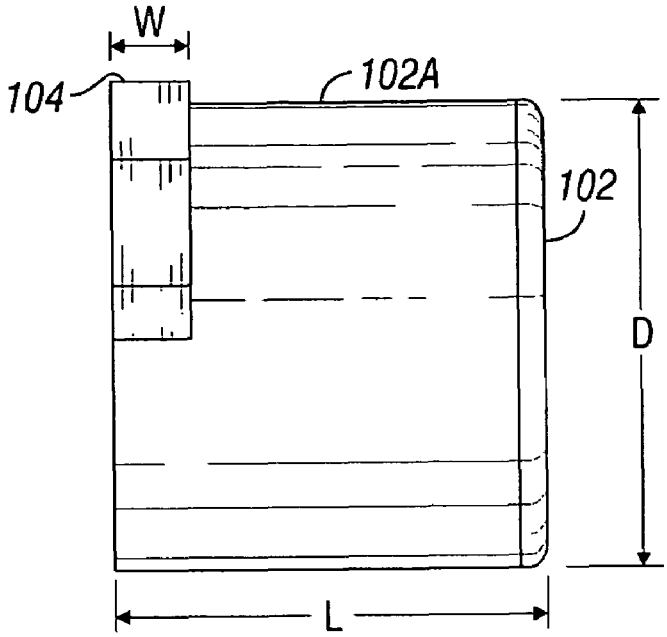
FIG. 4 (Prior Art)
FIG. 4 shows a side view of one example of a prior art displacement.
Figure 5:
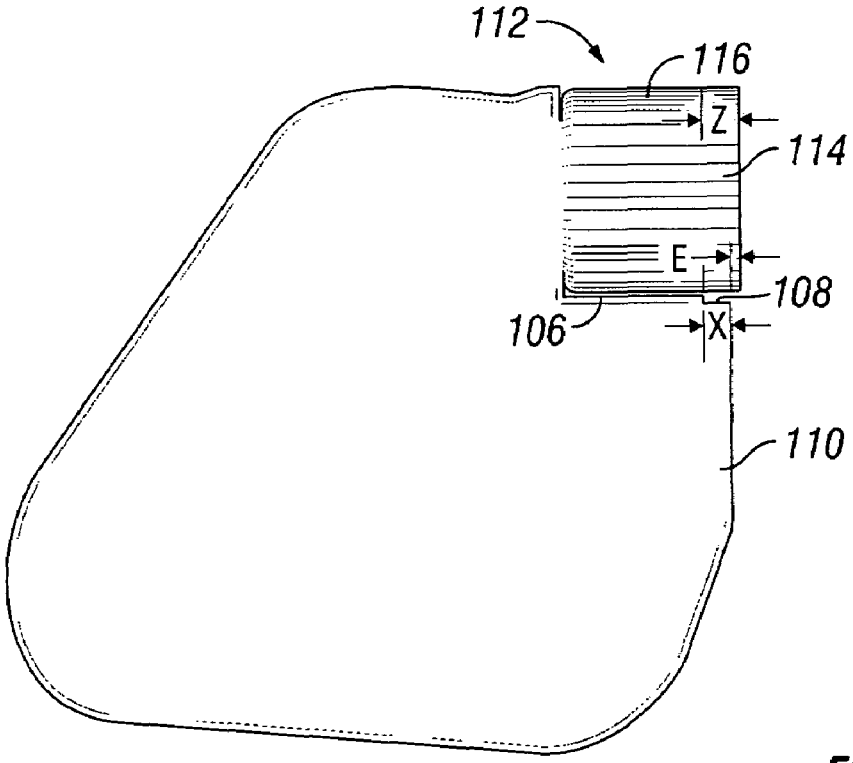
FIG. 5 (Prior Art)
FIG. 5 shows a cross section of a drill bit body having a prior art cutting element mounted on a pad.

The present invention relates to shaped cutters that provide advantages when compared to prior art cutters. In particular, embodiments of the present invention relate to cutters that have structural modifications to the cutting edge in order to improve cutter performance. As a result of the modifications, embodiments of the present invention may provide improved cooling, higher cutting efficiency, improved cutter durability, and longer lasting cutters when compared with prior art cutters. Embodiments of the present invention may shift thermal stress induced during brazing and thermal mechanical stress from drilling away from the cutter interface and onto the cutter substrate. Additionally, embodiments of the present invention may reduce the impact damages to the cutter that may occur from localized diamond-matrix contact.

Embodiments of the present invention relate to cutters having a substrate or support stud, which in some embodiments may be made of carbide, for example tungsten carbide, and an ultra hard cutting surface layer or "table" made of a polycrystalline diamond material or a polycrystalline boron nitride material deposited onto or otherwise bonded to the substrate at an interface surface. Also, in selected embodiments, the ultra-hard layer may comprise a "thermally stable" layer. One type of thermally stable layer that may be used in embodiments of the present invention is leached polycrystalline diamond.

A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

In order to obviate this problem, strong acids may be used to "leach" the cobalt from the diamond lattice structure.

Examples of "leaching" processes can be found, for example in U.S. Pat. Nos. 4,288,248 and 4,104,344. Briefly, a hot strong acid, e.g., nitric acid, hydrofluoric acid, hydrochloric acid, or perchloric acid, or combinations of several strong acids may be used to treat the diamond table, removing at least a portion of the catalyst from the PDC layer.

Removing cobalt causes the diamond table to become more heat resistant, but also causes the diamond table to be more brittle. Accordingly, in certain cases, only a select portion (measured either in depth or width) of a diamond table is leached, in order to gain thermal stability without losing impact resistance. As used herein, thermally stable polycrystalline diamond compacts include both of the above (i.e., partially and completely leached) compounds. In one embodiment of the invention, only a portion of the polycrystalline diamond compact layer is leached. For example, a polycrystalline diamond compact layer having a thickness of 0.01 inch may be leached to a depth of 0.006 inches. In other embodiments of the invention, the entire polycrystalline diamond compact layer may be leached. A number of leaching depths may be used, depending on the particular application and depending on the thickness of the PDC layer, for example, in one embodiment the leaching depth may be 0.05 in.

Figure 8:
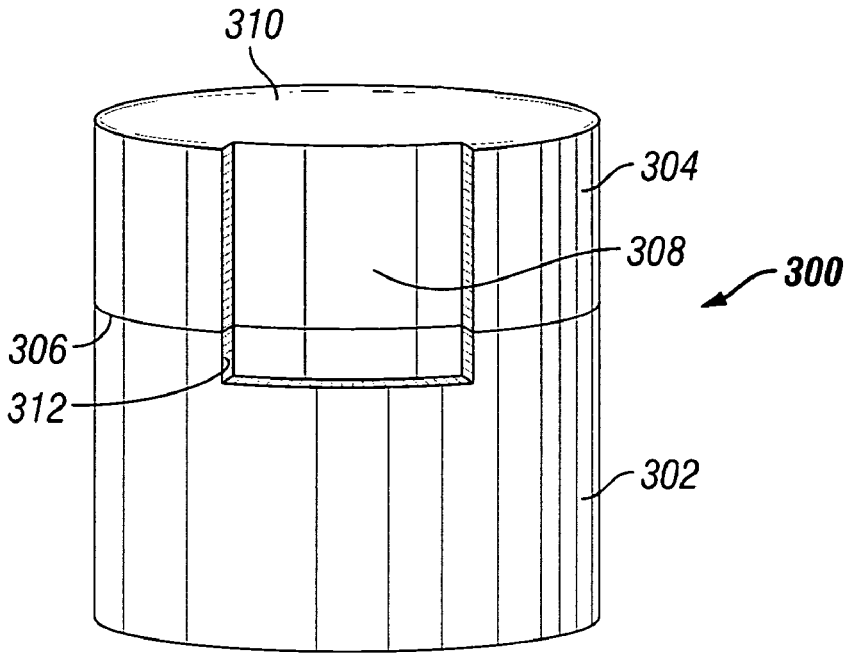
FIG. 8 shows a cutter in accordance with an embodiment of the invention.

FIG. 8 shows a cutter formed in accordance with an embodiment of the present invention. In FIG. 8, a cutter 300 comprises a substrate or "base portion," 302, on which an ultrahard layer 304 is disposed. In this embodiment, the ultrahard layer 304 comprises a polycrystalline diamond layer. As explained above, when a polycrystalline diamond layer is used, the layer may further be partially or completely leached. Further, at least one relief groove 308 is formed on an outer surface of the cutter 300 and extends back from the cutting face 310 of the ultrahard layer 304. In one embodiment, the relief groove 308 extends back a selected distance past the interface 306 of the ultrahard layer 304 and the substrate 302. In one embodiment, the relief groove 308 comprises a notch, or groove. In one embodiment, the relief groove 308 may comprise beveled edges 312. Multiple relief grooves may be placed around the circumference of the cutter 300 so that the cutter 300 may be removed and reoriented for multiple uses. While the relief groove 308 appears to be rectangular in shape, one of ordinary skill in the art will appreciate that other shapes and sizes of recessed regions may be used without departing from the scope of the invention.

Modified cutters, as described herein, may be modeled using computer programs. In one embodiment, a modified cutter maybe be modeled and simulated during drilling using, for example, a finite element analysis (FEA) program. In this embodiment, the geometrical shape and material properties of the cutter may be entered into the FEA program. The modified cutter may then be simulated contacting an earth formation during drilling. The simulation of the modified cutter displays the forces acting on the modified cutter, for example, the stress induced on the cutter may be displayed, and the bottomhole geometry data. The positioning of the modified cutter in the cutter pocket and on the bit maybe be evaluated, as well as the geometrical dimensions of the modified cutter itself. The position of the modified cutter and geometrical dimensions of the modified cutter may be adjusted, and the simulation repeated, until the design of the modified cutter is optimized. The design of the modified cutter may be adjusted to reduce the stress induced on the modified cutter in specific regions of the modified cutter to reduce the risk of damage, failure, or breakage of the modified cutter.

Figure 6:
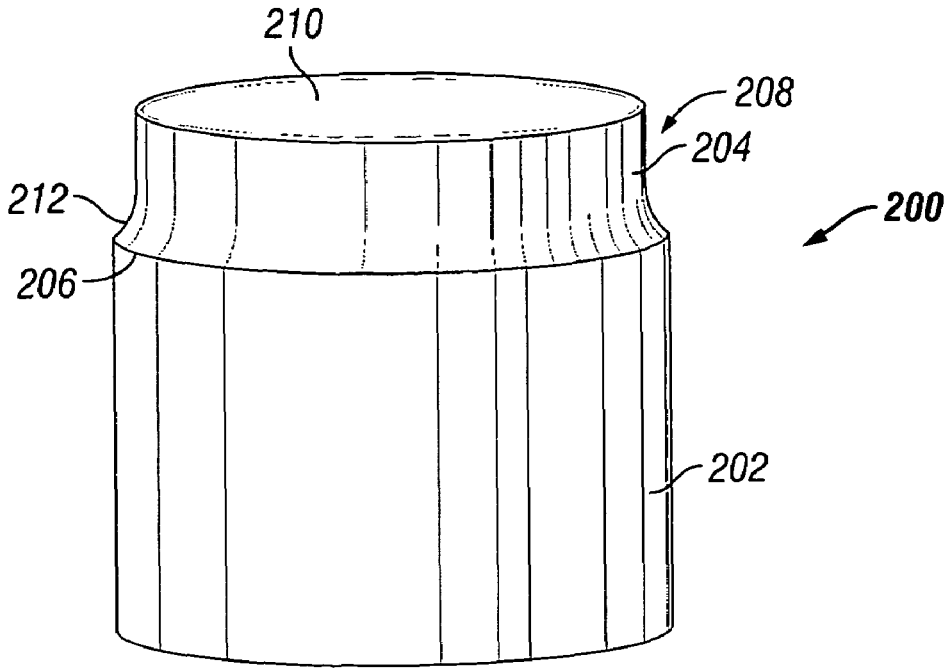
FIG. 6 shows a cutter in accordance with an embodiment of the invention.

In another embodiment of the present invention, shown in FIG. 6, a relief groove is achieved by forming a full groove around the circumference of a cutter 200. The relief groove 208 is formed on an outer surface of the cutter 200 and extends back a selected distance from the cutting face 210 of the cutter 200. In one embodiment, the relief groove 208 extends back to the interface 206 of the ultrahard layer 204 and the substrate 202. In one embodiment, the relief groove 208 may comprise a radiused edge 212 at the interface 206.

Figure 7:
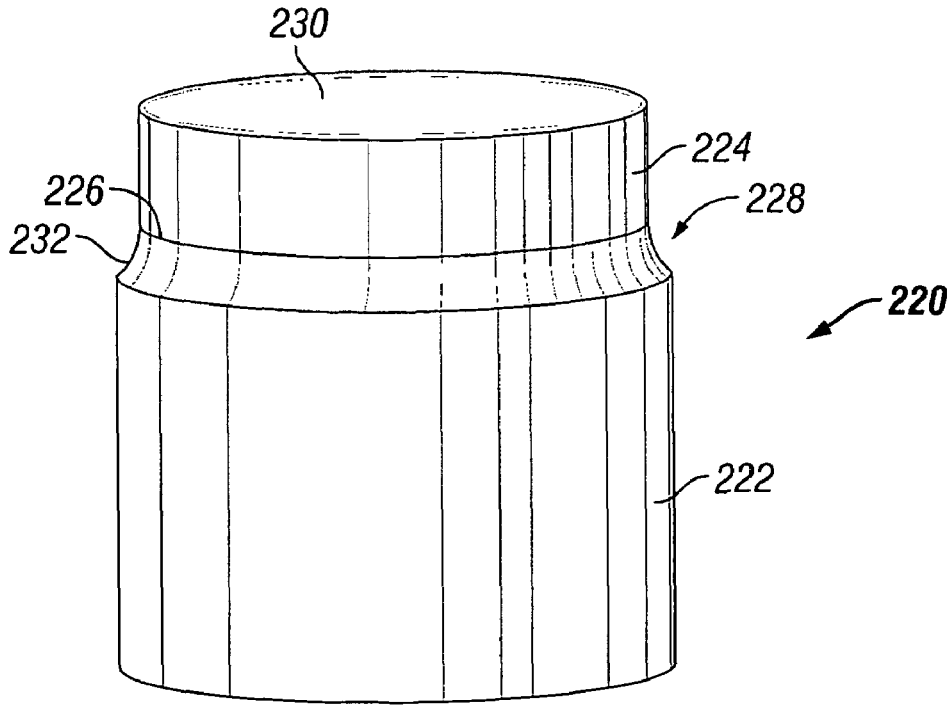
FIG. 7 shows a cutter in accordance with an embodiment of the invention.

FIG. 7 shows a cutter 220 in accordance with an embodiment of the invention with a relief groove 228 achieved by forming a full cut around the circumference of the cutter 220. The relief groove 228 is formed on an outer surface of the cutter 220 and extends back a selected distance from the cutting face 230 of the cutter 220. In one embodiment, the relief groove 228 extends back a selected distance past the interface 226 of the ultrahard layer 224 and the substrate 222. In one embodiment, the relief groove may comprise a radiused edge 232.

A cutter in accordance with embodiments of the invention has a relief groove formed proximate the cutting face of the cutter. When the cutter is inserted in the blade, the relief groove provides a relief gap between the ultrahard layer of the cutter and the inside surface of the cutter pocket of the blade. The relief groove reduces the impact damages on the cutter induced by the localized diamond-matrix contact of the ultrahard layer and the blade. By forming the relief groove on the cutter, the dimensions and geometry of the relief gap formed between the cutter and the cutter pocket are easier to control, and therefore more accurate and precise. The relief gap allows the thermal stress induced by brazing and the thermal mechanical stress from drilling to be shifted away from the interface of the ultrahard layer and the substrate, and onto the cutter substrate. Thus, embodiments of the present invention may provide improved cooling, higher cutting efficiency, improved cutter durability, and longer lasting cutters when compared with prior art cutters.

Figure 9:
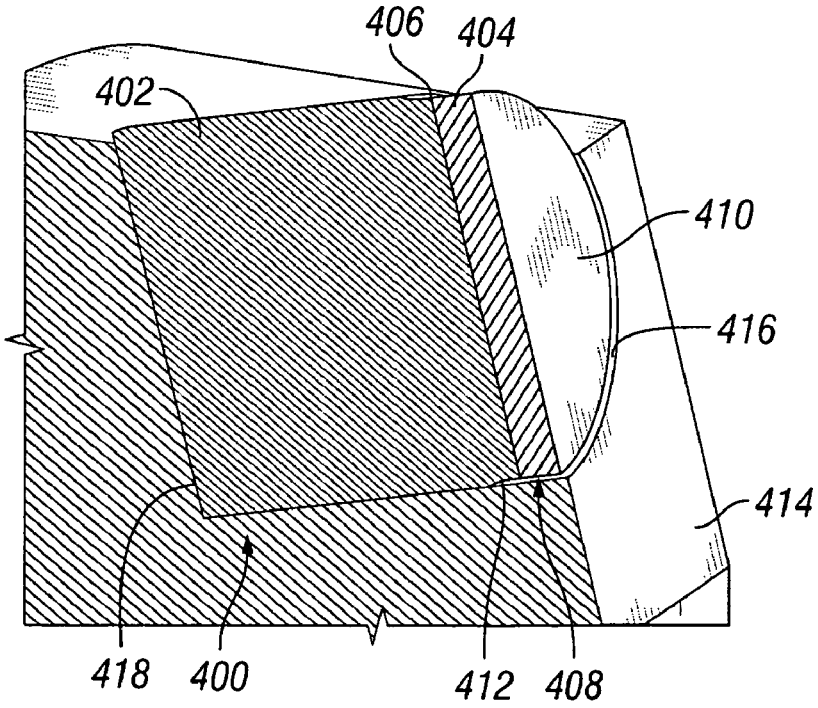
FIG. 9 shows a cutter in accordance with an embodiment of the invention mounted in a cutter pocket of a blade.

FIG. 9 shows a cutter 400, in accordance with an embodiment of the invention, disposed in a cutter pocket 418 of a blade 414. In one embodiment, a relief groove 408 is formed on the outer surface of the cutter 400 and extends back a selected distance from the cutting face 410 of the cutter 400. In one embodiment, the relief groove 408 extends back a selected distance past the interface 406 of the ultrahard layer 404 and the substrate 402. In one embodiment, the relief groove 508 comprises a radiused edge 412. The relief groove 408 of the cutter 400 forms a relief gap 416 between the ultrahard layer 404 and the inside surface of the cutter pocket 418 of the blade 414.

Cutters formed in accordance with embodiments of the present invention may be used either alone or in conjunction with standard cutters depending on the desired application. In addition, while reference has been made to specific manufacturing techniques, those of ordinary skill will recognize that any number of techniques may be used.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:

a bit body having at least one cutter pocket;

at least one cutter disposed in the at least pocket, the at least one cutter comprising a base portion, an ultrahard layer disposed on said base portion, and at least one relief groove formed on an outer surface of the ultrahard layer of the cutter, wherein the at least one relief groove extends backward from a cutting face a selected distance past an interface of the ultrahard layer and the base portion, and a relief gap formed between the at least one relief groove and an inside surface of the at least one cutter pocket.

2. The drill bit of claim 1, wherein the ultrahard layer comprises thermally stable polycrystalline diamond.

3. The drill bit of claim 1, wherein the at least one relief groove comprises a full cut around the circumference of the cutter.

4. The drill bit of claim 1, wherein the at least one relief groove comprises at least one notch.

5. The drill bit of claim 1, wherein the at least one relief groove comprises at least one radiused edge.

6. The drill bit of claim 1, wherein said base portion is substantially cylindrical in shape and has an end face upon which the ultrahard layer is disposed.

7. A method of drilling, comprising:

contacting a formation with a drill bit, wherein the drill bit comprises a bit body having at least one cutter pocket; and at least one cutter disposed in the at least one cutter pocket, the at least one cutter comprising a base portion, an ultrahard layer disposed on said base portion, and at least one relief groove formed on an outer surface of the ultrahard layer of the cutter, wherein the at least one relief groove extends backward from a cutting face a selected distance past an interface of the ultrahard layer and the base portion, and a relief gap formed between the at least one relief groove and an inside surface of the at least one cutter pocket of a blade.

8. A method of forming a relief gap in a cutter pocket of a drill bit, the method comprising:

forming a cutter comprising:

a base portion;

an ultrahard layer disposed on the base portion; and at least one relief groove formed on an outer surface of the ultrahard layer of the cutter, wherein the at least one relief groove extends backward from a cutting face a selected distance past an interface of the ultrahard layer and the base portion; and inserting the cutter in the cutter pocket, wherein the at least one relief groove is disposed within the cutter pocket.

9. A drill bit comprising:

a bit body having at least one cutter pocket;

at least one cutter disposed in the at least one cutter pocket, the at least one cutter comprising a base portion, a diamond table sintered to said base portion, and at least one relief groove subsequently formed on an outer surface of the diamond table of the cutter, wherein the at least one relief groove extends backward from a cutting face a selected distance past an interface of the diamond table and the base portion, and a relief gap formed between the at least one relief groove and an inside surface of the at least one cutter pocket.

10. The drill bit of claim 9, wherein the base portion is substantially cylindrical in shape and the diamond table is sintered to an end face of said base portion.

* * * * *